US010822202B2

(12) United States Patent
Lee et al.

(10) Patent No.: US 10,822,202 B2
(45) Date of Patent: Nov. 3, 2020

(54) UNITIZED SEGMENTED SHEAVE ASSEMBLY

(71) Applicant: OTIS Elevator Company, Farmington, CT (US)

(72) Inventors: Austin Lee, Danbury, CT (US); David R. Torlai, Torrington, CT (US); Jun Ma, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 133 days.

(21) Appl. No.: 16/034,646

(22) Filed: Jul. 13, 2018

(65) Prior Publication Data

US 2019/0047826 A1 Feb. 14, 2019

Related U.S. Application Data

(60) Provisional application No. 62/542,538, filed on Aug. 8, 2017.

(51) Int. Cl.
*B66B 15/04* (2006.01)

(52) U.S. Cl.
CPC ..... *B66B 15/04* (2013.01)

(58) Field of Classification Search
CPC ..... B66B 15/04; B66B 15/02; B66B 11/043; B66B 11/08
See application file for complete search history.

(56) References Cited

U.S. PATENT DOCUMENTS 2,283,014 A * 5/1942 Reid ..... D06B 3/36 118/672
2,426,967 A * 9/1947 Evans ..... B66D 5/00 254/267
3,279,762 A 10/1966 Henry
3,332,665 A * 7/1967 Bruns ..... B66D 3/06 254/393
4,108,280 A 8/1978 Eastcott et al.
4,222,551 A * 9/1980 Simon ..... B66C 1/40 177/132
6,250,608 B1 * 6/2001 Ridley ..... B66B 7/06 254/415

(Continued)

FOREIGN PATENT DOCUMENTS

CN 202220024 U 5/2012
CN 202785204 U 3/2013

(Continued)

OTHER PUBLICATIONS

Search Report dated Apr. 10, 2019 in U320982EP, EP Application No. 18187966, 8 pages.

*Primary Examiner* — Michael E Gallion
(74) *Attorney, Agent, or Firm* — Cantor Colburn LLP

(57) ABSTRACT

A unitized segmented sheave assembly is provided. The unitized segmented sleeve assembly includes sheaves arrayed in a side-to-side formation and respectively comprising bearings and an exterior running surface and spacers interleaved between neighboring sheaves. Respective inner races of the bearings of each sheave and respective interior portions of each spacer cooperatively form an interior annular surface. The unitized segmented sheave assembly further includes a sleeve disposable in abutment with the interior annular surface.

19 Claims, 4 Drawing Sheets

(56) References Cited

U.S. PATENT DOCUMENTS

| | | | | |
|---|---|---|---|---|
| 6,405,833 | B1 * | 6/2002 | Baranda | B66D 3/08 187/251 |
| 6,601,828 | B2 | 8/2003 | Strbuncelj et al. | |
| 7,614,611 | B1 | 11/2009 | Walton et al. | |
| 9,067,763 | B2 * | 6/2015 | Strbuncelj | B66B 11/043 |
| 9,428,370 | B1 | 8/2016 | Walton | |
| 2006/0070822 | A1 | 4/2006 | Osada et al. | |
| 2008/0289912 | A1 | 11/2008 | Perron | |
| 2013/0292211 | A1 * | 11/2013 | Polak | D07B 1/22 187/254 |
| 2016/0236909 | A1 * | 8/2016 | Lampinen | B66B 9/00 |
| 2017/0267497 | A1 * | 9/2017 | Ma | B66B 15/02 |

FOREIGN PATENT DOCUMENTS

| | | | |
|---|---|---|---|
| CN | 103171946 | A | 6/2013 |
| CN | 203095371 | U | 7/2013 |
| CN | 204124992 | U | 1/2015 |
| CN | 105438938 | A | 3/2016 |
| CN | 105438939 | A | 3/2016 |
| CN | 205527167 | U | 8/2016 |
| CN | 205739918 | U | 11/2016 |
| EP | 3056461 | A1 | 8/2016 |
| EP | 3103755 | A1 | 12/2016 |
| JP | H05278974 | A | 10/1993 |
| WO | 2012127394 | A1 | 9/2012 |
| WO | 2016019135 | A1 | 2/2016 |

* cited by examiner

UNITIZED SEGMENTED SHEAVE ASSEMBLY

CROSS-REFERENCE TO RELATED APPLICATIONS

This application claims the benefit of U.S. Provisional Patent Application No. 62/542,538 filed Aug. 8, 2017, which is incorporated herein by reference in its entirety.

BACKGROUND

The following description relates to sheave assemblies and, more specifically, to a unitized segmented sheave assembly.

In elevator applications, idler sheaves have been made from one large tube or rod that is machined into a required number of grooves. These idler sheaves then have bearings pressed into them on either side and a shaft is fit through the bearings and mounted into a hoistway. These tasks can be difficult when performed in the field. Moreover, as duty tables are expanded and the sheaves are required to become smaller, it is becoming increasingly difficult to fit bearings onto the idler sheaves with adequate life and ride quality.

One way to increase the life of the bearings is to create individual grooves. In these cases, each individual groove has bearings to support them on one shaft. This increases the number of bearings and leads to a decrease in load per bearing. It also creates a high bending stress on the shaft and can be difficult to install in the field due to all of the bearings and spacers in between sheaves that the shaft must pass through during the installation process.

BRIEF DESCRIPTION

According to an aspect of the disclosure, a unitized segmented sheave assembly is provided. The unitized segmented sleeve assembly includes sheaves arrayed in a side-to-side formation and respectively comprising bearings and an exterior running surface and spacers interleaved between neighboring sheaves. Respective inner races of the bearings of each sheave and respective interior portions of each spacer cooperatively form an interior annular surface. The unitized segmented sheave assembly further includes a sleeve disposable in abutment with the interior annular surface.

In accordance with additional or alternative embodiments, each exterior running surface of each sheave is bracketed by a set of radial flanges.

In accordance with additional or alternative embodiments, each sheave includes at least one of an elastic element axially interposed between a set of bearings and a set of integral bearings.

In accordance with additional or alternative embodiments, the elastic element includes a wave spring.

In accordance with additional or alternative embodiments, outer races of the bearings of each sheave are at least one of adjacent to and integral with the exterior running surface.

In accordance with additional or alternative embodiments, the spacers form a gap between the neighboring sheaves.

In accordance with additional or alternative embodiments, the sleeve includes at least one of a tubular element, a tubular cage and a tubular element defining weight reduction holes.

In accordance with additional or alternative embodiments, the sleeve defines a bore into which a shaft is insertable.

In accordance with additional or alternative embodiments, a radial spacer is interposable between the shaft and the sleeve.

In accordance with additional or alternative embodiments, the radial spacer includes an elastomer.

According to another aspect of the disclosure, a unitized segmented sheave assembly is provided for use in an elevator system. The unitized segmented sheave assembly includes a plurality of sheaves arrayed in a side-to-side formation that is consistent with a configuration of the elevator system. Each sheave includes a wave spring axially interposed between a set bearings, an exterior running surface and radial flanges bracketing the exterior running surface. The unitized segmented sheave assembly also includes a plurality of spacers interleaved between neighboring ones of the plurality of sheaves to form gaps therein. Respective inner races of the set of bearings of each one of the plurality of sheaves and respective interior portions of each one of the plurality of spacers cooperatively form an interior annular surface. The unitized segmented sheave assembly further includes a sleeve that is disposable in abutment with the interior annular surface.

In accordance with additional or alternative embodiments, outer races of the bearings of each sheave are at least one of adjacent to and integral with the exterior running surface.

In accordance with additional or alternative embodiments, the sleeve includes at least one of a tubular element, a tubular cage and a tubular element defining weight reduction holes.

In accordance with additional or alternative embodiments, the sleeve defines a bore into which a shaft is insertable.

In accordance with additional or alternative embodiments, a radial spacer is interposable between the shaft and the sleeve.

In accordance with additional or alternative embodiments, the radial spacer includes an elastomer.

According to yet another aspect of the disclosure, a method of assembling a unitized segmented sheave is provided. The method includes securing a first end screw to a sleeve, sliding sheaves and spacers onto the sleeve in an interleaved side-to-side formation, securing a second end screw to the sleeve to lock the sheaves and spacers into place with the spacers forming gaps between neighboring sheaves and sliding a shaft into the sleeve.

In accordance with additional or alternative embodiments, each sheave includes a set of bearings, a wave spring axially interposed between the set of bearings, a running surface and radial flanges bracketing the running surface.

In accordance with additional or alternative embodiments, the method further includes applying a surface treatment to the sleeve.

In accordance with additional or alternative embodiments, the method further includes interposing a radial spacer between the shaft and the sleeve.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, a unitized segmented sheave assembly is provided. The unitized segmented sheave assembly includes multiple single sheave grooves, each with their own set of bearings, which are slid onto a unifying sleeve. In combination with end screws, the sleeve unitizes all of the individual sheave grooves by locking them into position thereon. The sleeve allows for relatively simple installation in a hoistway of an elevator system by passing a shaft through and into a slip fit connection with the sleeve. The sleeve also provides additional support for addressing bending stresses and allows for any number of required sheave grooves to be installed so that a given incidence can be customized based on application.

Figure 1:
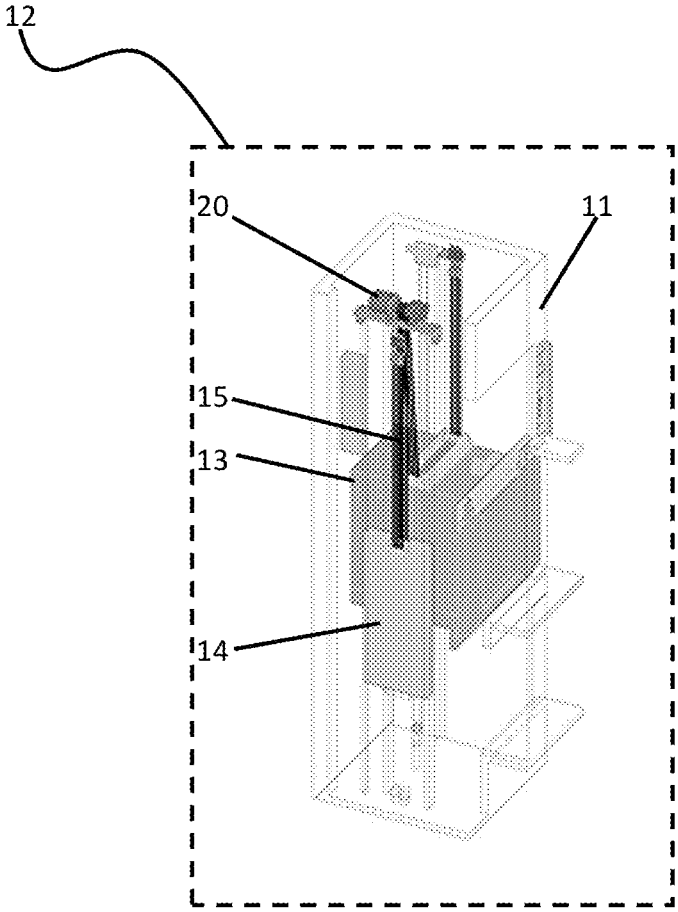
FIG. 1 is a perspective view of an elevator system in accordance with embodiments.

With reference to FIG. 1, an elevator system 10 is provided. The elevator system 10 is disposed in a hoistway 11 of a multi-level building 12 and includes a car 13, a counterweight 14, a rope 15 and a unitized segmented sheave assembly 20. The unitized segmented sheave assembly 20 may be disposed at an upper region of the building 12. The rope 15 extends from a roof of the car 13, over the unitized segmented sheave assembly 20 and to the counterweight 14. When the elevator system 10 is engaged to move the car 13 from one level of the building 12 to another, rotating elements of the unitized segmented sheave assembly 20 rotate and cause the rope 15 to lift or lower the car 13 between the various levels of the building 12.

In accordance with embodiments, the rope 15 may be formed as a plurality of flat ropes 15. Each flat rope 15 extends from the roof of the car 13, over a corresponding sheave of the unitized segmented sheave assembly 20 and to the counterweight 14. A number of the flat ropes 15 may be dictated by, among other factors, a weight of the car 13 and local requirements. As such, a number of the corresponding sheaves of the unitized segmented sheave assembly may be similarly dictated by, among other factors, the weight of the car 13 and local requirements.

Figure 2:
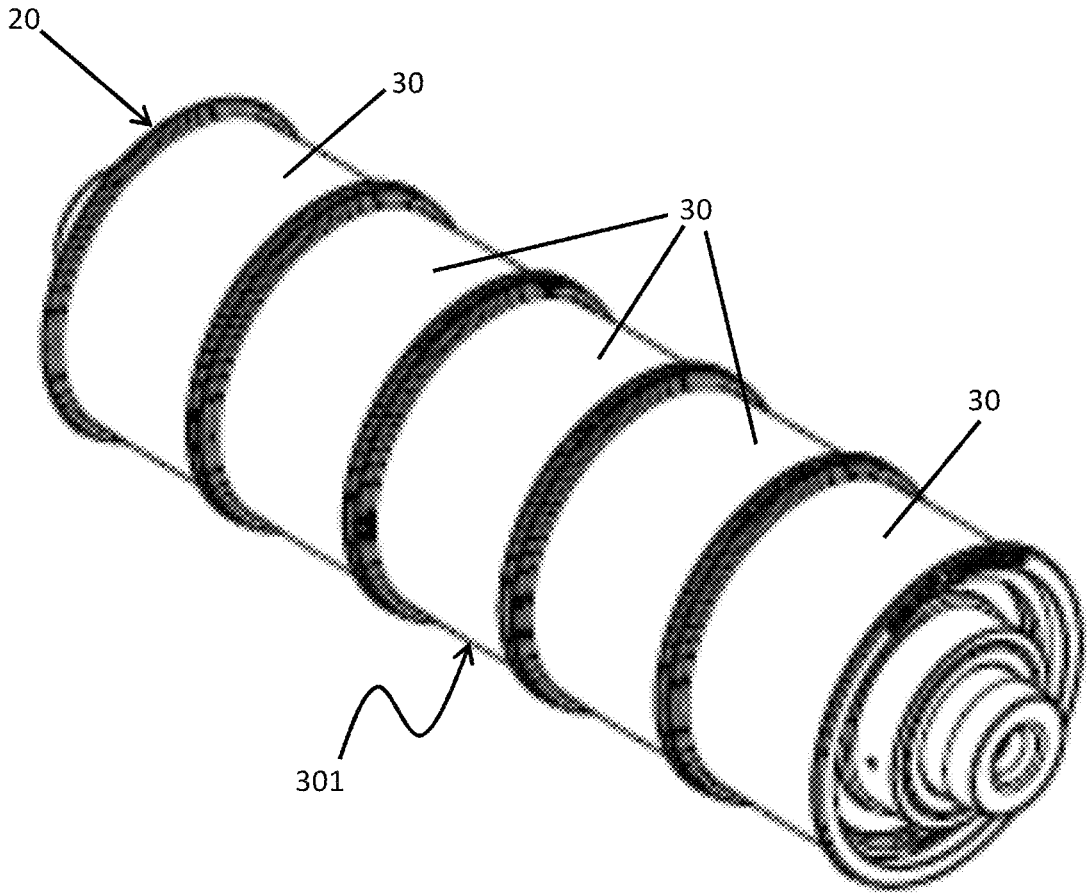
FIG. 2 is a perspective view of a unitized segmented sheave assembly of the elevator system of FIG. 1.
Figure 3:
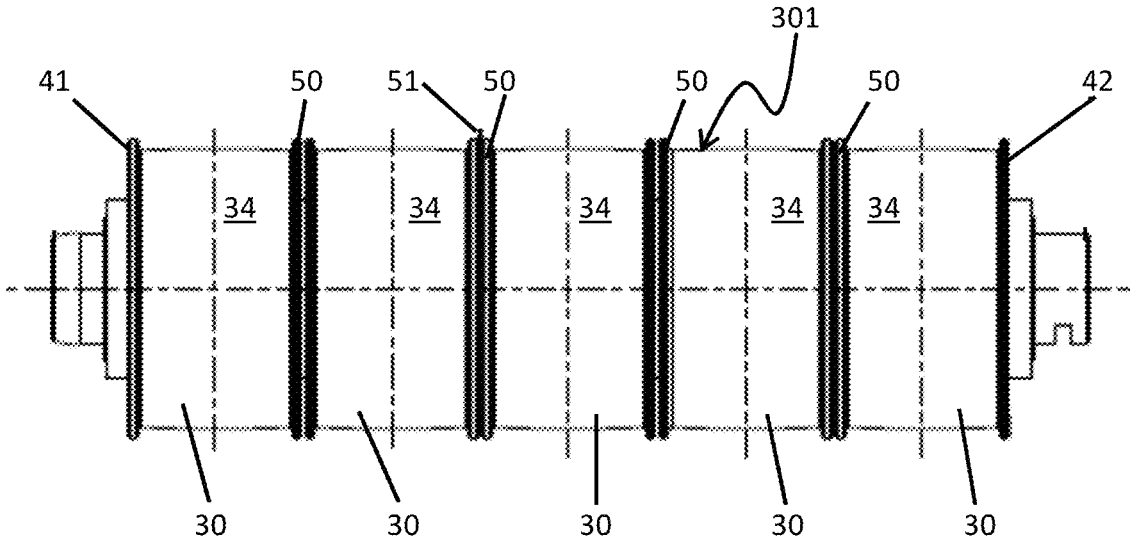
FIG. 3 is a side view of the unitized segmented sheave assembly of FIG. 2.
Figure 4:
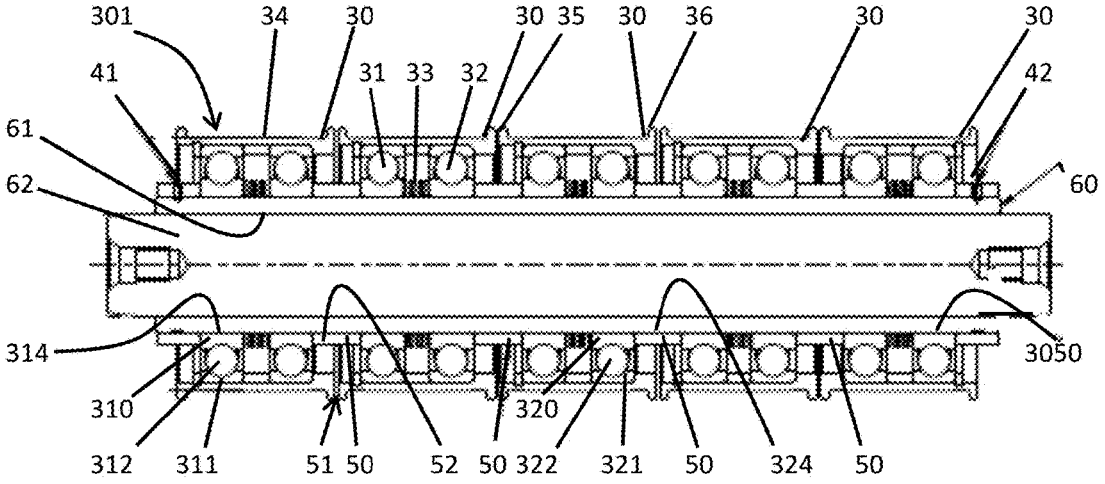
FIG. 4 is a cross-sectional view of the unitized segmented sheave assembly of FIGS. 2 and 3.

With reference to FIGS. 2-4, the unitized segmented sheave assembly 20 of FIG. 1 includes sheaves 30, first and second end screws 41 and 42, spacers 50 and a sleeve 60.

The sheaves 30 are arrayed with each other in a side-to-side formation 301 with the spacers 50 between the first and second end screws 41 and 42 along an axial length of the sleeve 60. Each of the sheaves 30 includes a set of first and second bearings 31 and 32, an elastic element 33 that is axially interposed between the set of first and second bearings 31 and 32, an exterior running surface 34 and a set of first and second radial flanges 35 and 36 axially bracketing the exterior running surface 34. The sheaves 30, the set of first and second bearings 31 and 32 and the elastic element 33 may be provided as separate components or as integral components in order to reduce numbers of parts. The following description will relate to the former case, however, for purposes of clarity and brevity. The elastic element 33 may be provided as a wave spring or as another suitable elastic feature. The spacers 50 are interleaved between neighboring sheaves 30 to form gaps 51 (on the order of, e.g., about 2 mm) between the neighboring sheaves 30.

Each first bearing 31 includes an inner race 310, an outer race 311 and a rotation bearing element 312 interposed between the inner race 310 and the outer race 311 to support rotational movement of the outer race 311 relative to the inner race 310. The inner race 310 may include an interior portion 314. The outer race 311 may be at least one of adjacent to and integrally formed with the exterior running surface 34. Similarly, as shown in FIG. 4, each second bearing 32 includes an inner race 320, an outer race 321 and a rotation bearing element 322 interposed between the inner race 320 and the outer race 321 to support rotational movement of the outer race 321 relative to the inner race 320. The inner race 320 may include an interior portion 324. The outer race 321 may be integrally formed with the exterior running surface 34.

The respective inner races 310, 320 of the first and second bearings 31 and 32 of each sheave 30 and respective interior portions 52 of each spacer 50 cooperatively form an interior annular surface 3050. The sleeve 60 is disposable in abutment with the interior annular surface 3050.

Figure 5:
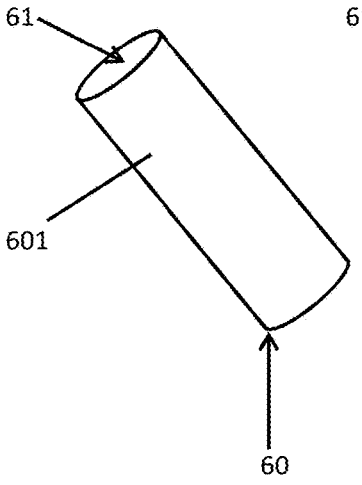
FIG. 5 is a side view of a sleeve of the unitized segmented sheave assembly of FIGS. 2-4 in accordance with further embodiments.
Figure 6:
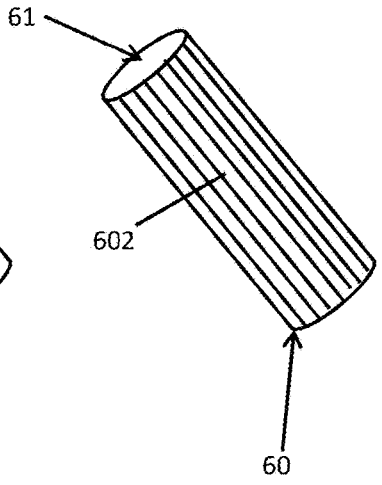
FIG. 6 is a side view of a sleeve of the unitized segmented sheave assembly of FIGS. 2-4 in accordance with further embodiments.
Figure 7:
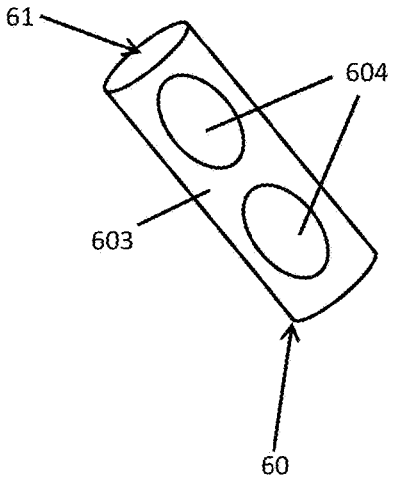
FIG. 7 is a side view of a sleeve of the unitized segmented sheave assembly of FIGS. 2-4 in accordance with further embodiments.

With continued reference to FIGS. 2-4 and with additional reference to FIGS. 5-7, the sleeve 60 may include or be provided as at least one of a tubular element 601 (see FIG. 5), a tubular cage 602 (see FIG. 6) and a tubular element 603 defining weight reduction holes 604 (see FIG. 7). As shown in FIG. 5, the tubular element 601 may be a substantially cylindrical feature with parallel open ends and a cylindrical sidewall extending between the parallel open ends. As shown in FIG. 6, the tubular cage 602 may be formed as a tubular array of bars that may contact each other or are separate from one another and extend in an axial dimension between opposite axial rings but cumulatively weight less than the tubular element 601 of FIG. 5. As shown in FIG. 7, the tubular element 603 may be similar to the tubular element 601 of FIG. 5 but may also define one or more of the weight reduction holes 604 in order to reduce a weight of the tubular element 603.

In any case, the sleeve 60 may be formed to define a bore 61 along a central longitudinal axis thereof. A shaft 62 of the hoistway machine 16 (see FIG. 1) may be insertable into and through this bore 61.

Figure 8:
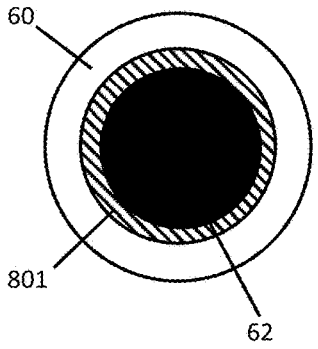
FIG. 8 is an enlarged side view of a portion of the unitized segmented sheave assembly of FIGS. 2-4 in accordance with further embodiments.

In accordance with further embodiments and with reference to FIG. 8, a radial spacer 801 may be radially interposable between the shaft 62 and the sleeve 60. The radial spacer 801 may include or be provided as an elastomer or another suitable material.

Figure 9:
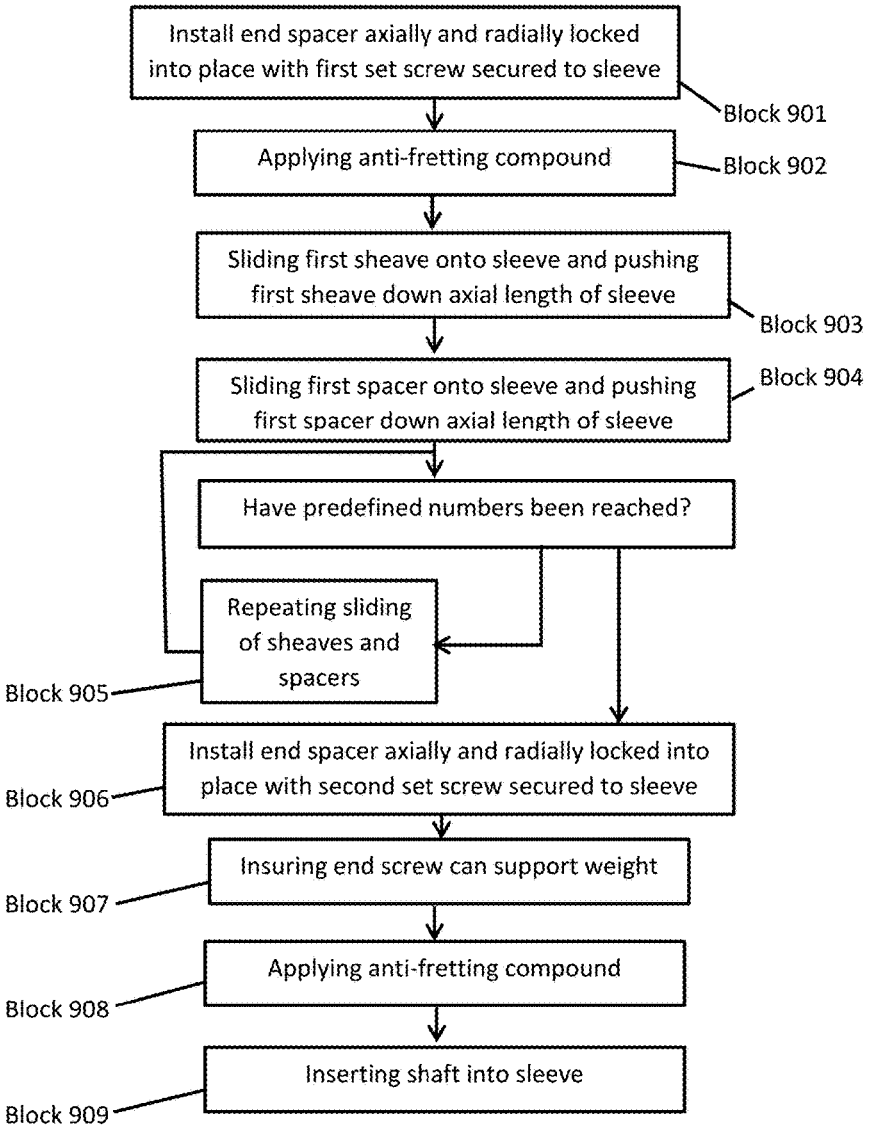
FIG. 9 is a flow diagram illustrating a method of assembling a unitized segmented sheave assembly in accordance with embodiments.

With reference to FIG. 9, a method of assembling a unitized segmented sheave, such as the unitized segmented sheave assembly 20 described herein, is provided. As shown in FIG. 9, the method includes installing an end spacer that is axially and radially locked into plate with a first set screw that is secured to a sleeve as described above and ensuring positioning by tightening (block 901) and then applying an anti-fretting compound to the sleeve (block 902). Next, the method includes sliding a first sheave as described above onto the sleeve and pushing the first sheave down a length of the sleeve to the first end screw (block 903), sliding a first spacer as described above onto the sleeve and pushing the first spacer down the length of the sleeve to the first sheave (block 904) and repeating the sliding and pushing of additional sheaves and spacers (block 905) until predefined numbers of each are reached. At this point, the method includes installing an end spacer that is axially and radially locked into place with a second set screw that is secured to the sleeve and ensuring positioning by tightening (block 906) whereupon the structural soundness of the first and second end screws are verified by tilting the assembly vertically to insure that the first and second end screws can hold the weight of the sheaves and the spacers (block 907). Next, additional anti-fretting compound is applied to opposite ends of the sleeve and to a shaft (block 908) and the shaft is inserted into the sleeve with or without a radial spacer interposed between the shaft and the sleeve (block 909).

The unitized segmented sheave provides several key benefits when compared to traditional idler and deflector sheaves. These include, but are not limited to, significantly increased bearing life, relatively simple and easy installation which protects bearing IDs and reduces installation times, available customization for a number of grooves to be installed (e.g. only 4 grooves are required in many installations that utilize a machine with 5 grooves), sheave and bearing integration (i.e., the bearing outer surface is the suspension member contact surface removing the need to press the bearing into a sheave), components can be non-metallic (e.g., sleeve, load bearing surface, spacers, etc.) to reduce cost and weight, individually rotating sheaves allows for better tension equalization across belts and increased bending stress support is provided for.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A unitized segmented sheave assembly, comprising:

sheaves arrayed in a side-to-side formation and respectively comprising bearings and an exterior running surface;

spacers interleaved between neighboring sheaves, respective inner races of the bearings of each sheave and respective interior portions of each spacer cooperatively forming an interior annular surface; and a sleeve disposable in abutment with the interior annular surface, wherein each of the sheaves comprises an elastic element interposed between the corresponding bearings.

2. The unitized segmented sheave assembly according to claim 1, wherein each exterior running surface of each sheave is bracketed by a set of radial flanges.

3. The unitized segmented sheave assembly according to claim 1, wherein the elastic element of each of the sheaves comprises a wave spring interposed between interior sides of the corresponding bearings.

4. The unitized segmented sheave assembly according to claim 1, wherein outer races of the bearings of each sheave are integral with the exterior running surface.

5. The unitized segmented sheave assembly according to claim 1, wherein each of the spacers is interposed between exterior sides of corresponding neighboring bearings and forms a gap between the corresponding neighboring sheaves.

6. The unitized segmented sheave assembly according to claim 1, wherein the sleeve comprises at least one of a tubular cage and a tubular element defining weight reduction holes.

7. The unitized segmented sheave assembly according to claim 1, wherein the sleeve defines a bore into which a shaft is insertable.

8. The unitized segmented sheave assembly according to claim 7, further comprising a radial spacer interposable between the shaft and the sleeve.

9. The unitized segmented sheave assembly according to claim 8, wherein the radial spacer comprises an elastomer.

10. A unitized segmented sheave assembly for use in an elevator system, the unitized segmented sheave assembly comprising:

a plurality of sheaves arrayed in a side-to-side formation which is consistent with a configuration of the elevator system, each one of the plurality of sheaves comprising a set of bearings, a wave spring axially interposed between interior sides of the set bearings, an exterior running surface and radial flanges bracketing the exterior running surface;

a plurality of spacers interposed between exterior sides of corresponding neighboring bearings and thereby interleaved between corresponding neighboring ones of the plurality of sheaves to form gaps therein, respective inner races of the set of bearings of each one of the plurality of sheaves and respective interior portions of each one of the plurality of spacers cooperatively forming an interior annular surface; and a sleeve disposable in abutment with the interior annular surface.

11. The unitized segmented sheave assembly according to claim 10, wherein outer races of the bearings of each sheave are integral with the exterior running surface.

12. The unitized segmented sheave assembly according to claim 10, wherein the sleeve comprises at least one of a tubular cage and a tubular element defining weight reduction holes.

13. The unitized segmented sheave assembly according to claim 10, wherein the sleeve defines a bore into which a shaft is insertable.

14. The unitized segmented sheave assembly according to claim 13, further comprising a radial spacer interposable between the shaft and the sleeve.

15. The unitized segmented sheave assembly according to claim 14, wherein the radial spacer comprises an elastomer.

16. A method of assembling a unitized segmented sheave, the method comprising:

securing a first end screw to a sleeve;

sliding sheaves, each of which comprises a set of bearings, a wave spring axially interposed between interior sides of the corresponding set of bearings;

sliding spacers onto the sleeve in an interleaved side-to-side formation with each of the sheaves such that each spacer is interposed between exterior sides of bearings of corresponding neighboring sheaves;

securing a second end screw to the sleeve to lock the sheaves and spacers into place with the spacers forming gaps between neighboring sheaves; and sliding a shaft into the sleeve.

17. The method according to claim 16, wherein each sheave further comprises:

a running surface; and radial flanges bracketing the running surface.

18. The method according to claim 16, further comprising applying a surface treatment to the sleeve.

19. The method according to claim 16, further comprising interposing a radial spacer between the shaft and the sleeve.

* * * * *